US008787802B2

(12) United States Patent
Hattori et al.

(10) Patent No.: US 8,787,802 B2
(45) Date of Patent: Jul. 22, 2014

(54) DEVELOPING DEVICE, PROCESS CARTRIDGE, AND IMAGE-FORMING APPARATUS

(75) Inventors: Yoshio Hattori, Kawasaki (JP); Atsushi Nakamoto, Kawasaki (JP); Yoshiyuki Fukuda, Machida (JP); Toshio Koike, Machida (JP); Hiroaki Okamoto, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 176 days.

(21) Appl. No.: 13/334,864

(22) Filed: Dec. 22, 2011

(65) Prior Publication Data

US 2012/0163874 A1 Jun. 28, 2012

(30) Foreign Application Priority Data

Dec. 22, 2010 (JP) ..... 2010-286498

(51) Int. Cl.
*G03G 15/08* (2006.01)

(52) U.S. Cl.
USPC ..... 399/254; 399/257

(58) Field of Classification Search
CPC ..... G03G 15/0822; G03G 15/0839; G03G 2215/0822
USPC ..... 399/254, 256, 257, 259, 260
See application file for complete search history.

(56) References Cited

U.S. PATENT DOCUMENTS

| | | | | |
|---|---|---|---|---|
| 5,835,822 | A | 11/1998 | Nagasaki et al. | |
| 5,884,136 | A | 3/1999 | Takei et al. | |
| 5,895,143 | A | 4/1999 | Kawahara et al. | |
| 6,088,556 | A | 7/2000 | Nagasaki et al. | |
| 6,259,876 | B1 * | 7/2001 | Fukuda et al. | 399/254 |
| 7,813,680 | B2 | 10/2010 | Masuda et al. | |
| 8,023,855 | B2 | 9/2011 | Hattori et al. | |
| 2001/0043818 | A1 * | 11/2001 | Shida et al. | 399/58 |
| 2009/0245882 | A1 | 10/2009 | Ozeki et al. | |
| 2009/0245889 | A1 | 10/2009 | Koetsuka et al. | |

(Continued)

FOREIGN PATENT DOCUMENTS

| | | |
|---|---|---|
| JP | 5-333691 | 12/1993 |
| JP | 9-81016 | 3/1997 |

(Continued)

OTHER PUBLICATIONS

Office Action mailed Apr. 15, 2014, in Japanese Patent Application No. 2010-286498, filed Dec. 22, 2010 (5 pages).

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

Developing devices, process cartridges and image-forming apparatuses, having a chamber for conveying recovered developer on the top of another chamber for conveying supplying developer, where the developer is conveyed by screws inside the chambers respectively, when mixing and conveying the developing agent, a shielding member which separates the chambers, a guide section is provided in the shielding member to guide a developing agent which has left a developing roller toward the screw in the upper chamber, and a third communication section is provided next to the guide section, at the back of where the guided developer contacts the screw wings in the upper chamber, and the third communication section communicates the chambers with each other, and the third communication section is provided from center to downstream in the conveyance direction of the developer by the screw upper.

18 Claims, 8 Drawing Sheets

(56) References Cited

U.S. PATENT DOCUMENTS

| | | | |
|---|---|---|---|
| 2010/0202805 | A1 | 8/2010 | Miyoshi et al. |
| 2011/0008073 | A1 | 1/2011 | Kudo et al. |
| 2011/0058858 | A1 | 3/2011 | Fukuda et al. |
| 2011/0129262 | A1 | 6/2011 | Nakamoto |
| 2011/0150525 | A1 | 6/2011 | Fujiwara et al. |
| 2011/0217085 | A1 | 9/2011 | Hattori et al. |

FOREIGN PATENT DOCUMENTS

| | | |
|---|---|---|
| JP | 11-030913 | 2/1999 |
| JP | 11-174810 | 7/1999 |
| JP | 11-231625 | 8/1999 |
| JP | 2002-148927 | 5/2002 |
| JP | 2003-307924 | 10/2003 |
| JP | 2006-171134 | 6/2006 |
| JP | 2011-174954 | 9/2011 |

* cited by examiner

DEVELOPING DEVICE, PROCESS CARTRIDGE, AND IMAGE-FORMING APPARATUS

CROSS REFERENCE TO RELATED APPLICATIONS

The present application is based on and claims priority from Japanese Application No. 2010-286498, filed Dec. 22, 2010, the disclosure of which is hereby incorporated by reference herein in its entirety.

BACKGROUND OF THE INVENTION

1. Field of the Invention

The present invention relates to developing devices, process cartridges and image-forming apparatuses, more particularly, conveyance and stirring mechanisms of two-component developing agents.

2. Description of Related Art

In image-forming apparatuses such as copying machines, printers, facsimile apparatuses and printing machines, an electrostatic image on a photoconductor as an image carrier is visualized with a developing apparatus and is transferred onto a sheet and so on to obtain a record-output.

For the developing agent used in the developing, there is a two-component-type composed of toner and carrier mixture, in addition to a one-component type only of magnetic or non-magnetic toner.

The two-component developing agent is composed of toner and its carrier, and by charging the toner with triboelectric charging when mixing by stirring, the toner becomes in a condition able to adhere electro-statically onto a latent electrostatic image on a photoconductor.

As a configuration of the developing apparatuses to mix the developing agent in the course of a conveying process, it is proposed that screws used in conveying the developing agent be arranged one above the other, and supply and recovery units of the developing agent be arranged vertically relative to a developing agent-bearing member (for example, see Patent literatures 1-3). Patent literature 1 is JPA No. 1111-174810, Patent literature 2 is JPA No. H05-333691 and Patent literature 1 is JPA No. 2003-307924.

Patent literature 1 discloses a configuration in which the developer supply unit is arranged under the developer recovery unit, and discloses a blade to control the layer thickness of the developing agent and its arrangement under the developing agent-bearing member on the side of the developer supply unit.

Patent literatures 2 and 3 disclose another configuration regarding the positional relationship; namely, the developer supply unit and the developer recovery unit of Patent literature 1 are changed in a vertical direction.

In the developer recovery unit, the developing agent increases in level by going from upstream to downstream due to a rotation of the conveying screw. In sum, FIG. 11 shows a configuration as disclosed in Patent literature 1.

As shown in FIG. 11, a developing agent is conveyed and mixed by a conveyance screw 101 provided in a conveyance space GR1 in the recovery side, and once the developing agent has reached an end of the conveyance screw 101, this developing agent surges to the side of a communication section R1 which leads to a further increase in the level due to its accumulation.

In the developer supply unit as shown in FIG. 11, the volume of the developing agent decreases by toner consumption of the developing agent due to its adhesion to a developing roller in the course of conveying by a conveyance screw 102 provided in a conveyance space GR2. So, the volume of the developing agent decreases by following through to the end of the conveyance screw 102, which leads to a decrease in the level of developing agent.

The developing agent reaches to the end of the conveyance screw 102, and moves through a communication section R2 to the conveyance space GR1 again, so that one-way circulation of the developing agent is accomplished.

As for such a one-way circulation of the developing agent described above, it is necessary that the circulation of the developing agent be carried out steadily, but if the level of the developing agent is increased in the developer recovery unit as above-mentioned, it possibly becomes difficult to recover the developing agent.

As a result, it becomes impossible to recover from a developing agent-bearing member. If this member is a rolling member such as a roller and so on, one portion of the unrecovered developing agent is carried together with the rotation of the rolling member, and it sometimes invades directly into the developer supply unit.

This developing agent which directly invades into the developer supply unit from the developing roller is not one with the triboelectric charging by mixing being carried out properly, so that it possibly leads to a concentration deviation if it is supplied into the developing roller.

To increase the recovery efficiency, it is considered to increase a rotation speed of the conveyance screw. However, there is a possibility of causing toner degradation in the developing agent, due to friction heat caused by friction of the developing agent in the position where the level of the developing agent is increased.

In addition, it is necessary to increase a driving power in accordance with an increase in load on the conveyance screws due to the increased level of the developing agent, which results in the electric consumption of the driving source being increased.

SUMMARY OF THE INVENTION

The present invention is accomplished based on the problems when using the conventional developing apparatus in the related art above, particularly, based on the problems caused when using conveyance screws.

The present invention provides developing apparatuses to accomplish one-way circulation of the developing agent without causing an increase in the electric consumption and the friction heat which occurs in avoiding a poor conveyance due to the increased level of the developing agent.

The present invention also provides developing apparatuses, process cartridges and image-forming apparatuses, having a configuration which enables prevention of a concentration deviation and so on by preventing the recovered developing agent from invading into the developer recovery unit directly.

The present invention comprises a configuration as follows. A developing apparatus, storing a developing agent which contains a toner and its carrier, develops a latent image on a latent image carrier with the toner, comprising: a developing agent-bearing member, facing the latent image carrier, with magnetic poles formed around; a developing agent control member, being arranged under the developing agent-bearing member with facing this member, to control a volume of the developing agent on the developing agent bearing member; a developer recovery unit, being arranged at an upper position of a space which created by shielding an inside space of the developing apparatus, a developer supply unit, being arranged in a lower position of the created space, to supply the developing agent onto the developing agent bearing member; first developer conveying member, being arranged in the developer recovery unit; second developer conveying member, being arranged in the developer supply unit; and a shielding member, having first and second communication sections connecting the developer recovery unit and the developer supply unit, in accordance with both ends of the first and second developer conveying members in its longer direction respectively; wherein a guide section, being provided in the shielding member, guides a developing agent which has left from the developing agent-bearing member to the first developer conveying member in the developer recovery unit, and a third communication section is provided in the shielding member to communicate the developer recovery unit and the developer supply unit, apart from the first and second communication sections.

Another configuration according to the present invention is as follows. A developing apparatus, storing a developing agent which contains a toner and its carrier, develops a latent image on a latent image carrier with the toner, comprising: a developing agent-bearing member, facing the latent image carrier, with magnetic poles formed around; a developing agent control member, being arranged under the developing agent-bearing member while facing this member, to control a volume of the developing agent on the developing agent-bearing member; a developer recovery unit, being arranged at an upper position of a space which is created by shielding an inside space of the developing apparatus, a developer supply unit, being arranged in a lower position of the created space, to supply the developing agent onto the developing agent-bearing member; first and second developer conveying members, using screw members being arranged in the developer recovery unit and developer supply unit respectively; and a third communication section, being provided between bottoms of the developer recovery unit and the developer supply unit by communicating the bottoms; wherein the third communication opens at a position of facing screw wings of the first developer conveying member on the side of the developer recovery unit, and opens at a position of facing the axis of between wings of the second developer conveying member on the side of the developer supply unit.

The process cartridge or image-forming apparatus according to the present invention is as follows.

A process cartridge comprising; a casing for housing the developing apparatus above; a charging device for carrying out a charging step of charging the latent image carrier; and a cleaning device for removing residual toner from this latent image carrier.

An image-forming apparatus comprising the developing apparatus above.

Apart from the first and second communication sections located at both ends in the direction of the developing agent moving by the first developer conveying member of the developer recovery unit, the third communication section to communicate the developer supply unit and the developer recovery unit is provided between the center position in the moving direction of the developing agent and a position of the second communication section located on the downstream side in the developing agent moving direction.

Herewith, it is possible to prevent the level of the developing agent from getting higher on the downstream side in the direction of the developing agent moving by the first developer conveying member. This allows prevention of poor recovery of the developing agent when the level of the developing agent is high, and prevention of an impairment of circulation of the developing agent.

Especially, the shielding member, shielding the developer recovery unit and the developer supply unit, is next to the guide section which guides a recovered developing agent toward the first conveying member, and is provided in a location position corresponding to a time position when after the developing agent, moving by the guide section of the shielding member, begins to contact with the first developer conveying member.

Therefore, it is possible to make the recovered developing agent enter into the developer supply unit after being mixed by the first developer conveying member. By this, it is possible to prevent the recovered developing agent having a low triboelectric charging level by an inadequate mixing from entering into the developer supply unit. Thus it is possible to prevent an abnormal image density caused by an inadequate charge in advance.

BRIEF DESCRIPTION OF THE DRAWINGS

FIGS. 5A-1, 5A-2 and 5B are figures depicting a planar view and a front view of the developing apparatus in FIG. 3, and illustrating a circulation condition of the developing agent.

DETAILED DESCRIPTION OF THE PREFERRED EMBODIMENTS

Figure 1:
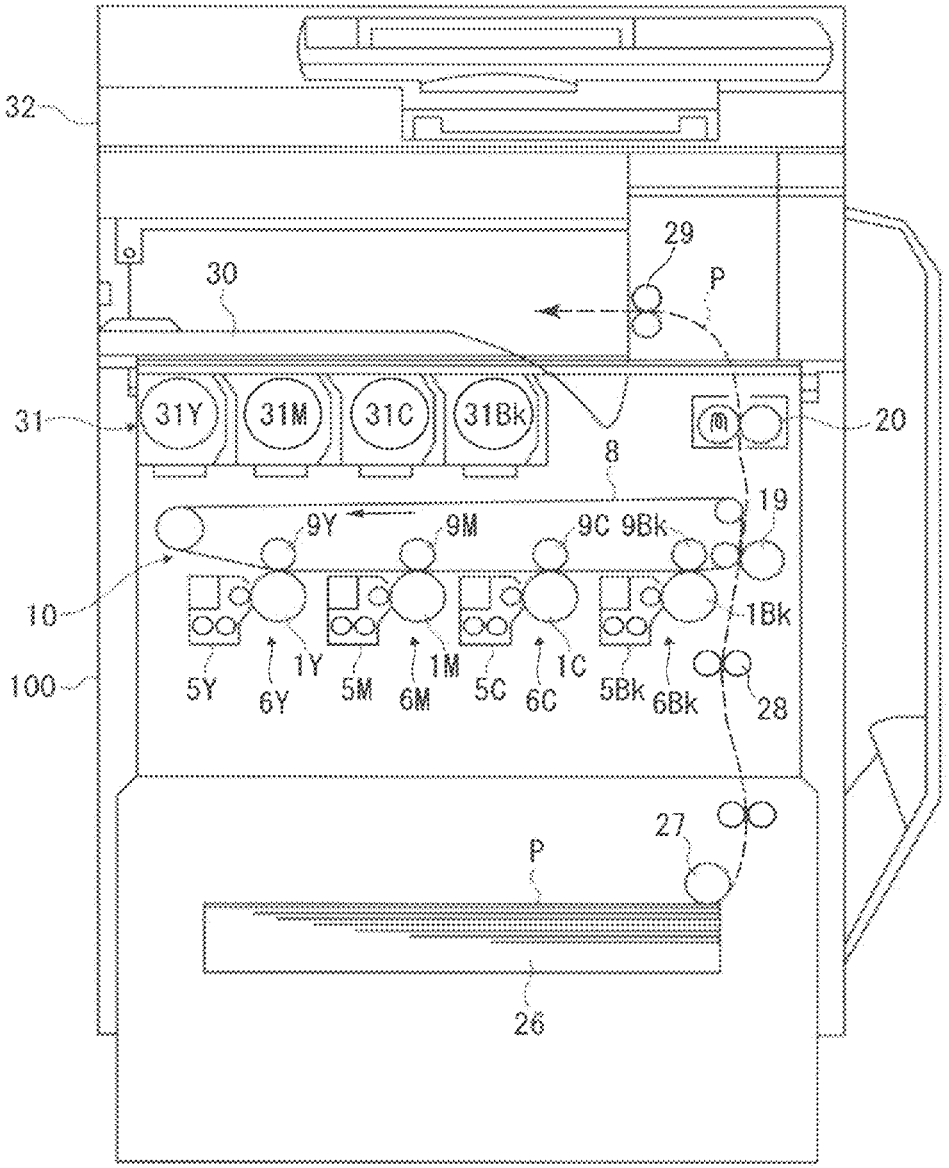
FIG. 1 is a view showing a frame format of an image-forming apparatus with a process cartridge having a developing apparatus according to the present invention, for explanation.

First, an embodiment according to the present invention will be explained by referring to the figure below. FIG. 1 is a view showing a frame format of the constitution of an image-forming apparatus with a process cartridge having a developing apparatus according to the present invention.

In FIG. 1, the reference numeral 10 denotes the body of a copying machine of tandem-color type which corresponds to an image-forming apparatus according to the present invention. The reference numeral 32 denotes an image-reading section to read image information of the manuscript, having a feed section to feed a manuscript. The reference numeral 30 denotes a catch tray to be stacked with duplicated papers output. The reference numeral 26 denotes a paper feed section where a recording medium P such as transfer paper and so on is housed.

The reference numeral 27 denotes a paper feed roller to feed recording media P housed in the paper feed section 26 one by one. The reference numeral 28 denotes a pair of registration rollers to adjust a timing of feeding the record medium P.

In addition, the reference numerals, 6Y, 6M, 6C and 6BK denote image-forming sections of colors (yellow (Y), magenta (M), cyan (C) and black (Bk)) respectively. The reference numerals 1Y, 1M, 1C and 1BK denote photoreceptor drums as image carriers respectively, where a toner image is formed by the color. The reference numerals 5Y, 5M, 5C and 5Bk denote developing apparatuses to develop latent images to be formed on the photoreceptor drums 1Y, 1M, 1C and 1Bk.

The reference numerals 9Y, 9M, 9C and 9Bk denote transfer bias rollers (first transfer bias rollers) to put and transfer toner images on the recording medium P respectively, the toner image having been formed on the photoreceptor drums 1 (1Y, 1M, 1C and 1Bk) respectively.

The reference numeral 8 denotes an intermediate transfer unit, having an intermediate transfer belt 8A where a toner image by the colors is put on and transferred. The reference numeral 19 denotes a second-transfer bias roller to transfer the image onto the record medium P, that is on the intermediate transfer belt 8A. The reference numeral 20 denotes a fixing device to fix unfixed images on the record medium P.

The reference numeral 31 denotes a bottle container to contain color toner bottles 31Y, 31M, 31C and 31BK, which supply toners (toner particles) by color (yellow, cyan, magenta and black) to the developing apparatuses 5 (5Y, 5M, 5C and 5Bk) respectively.

As shown in FIG. 1, the image-forming sections which correspond to the colors (yellow (Y), cyan (C), magenta (M) and black (B)) respectively are arranged in parallel facing the intermediate transfer belt 8A of intermediate transfer unit 8.

Figure 2:
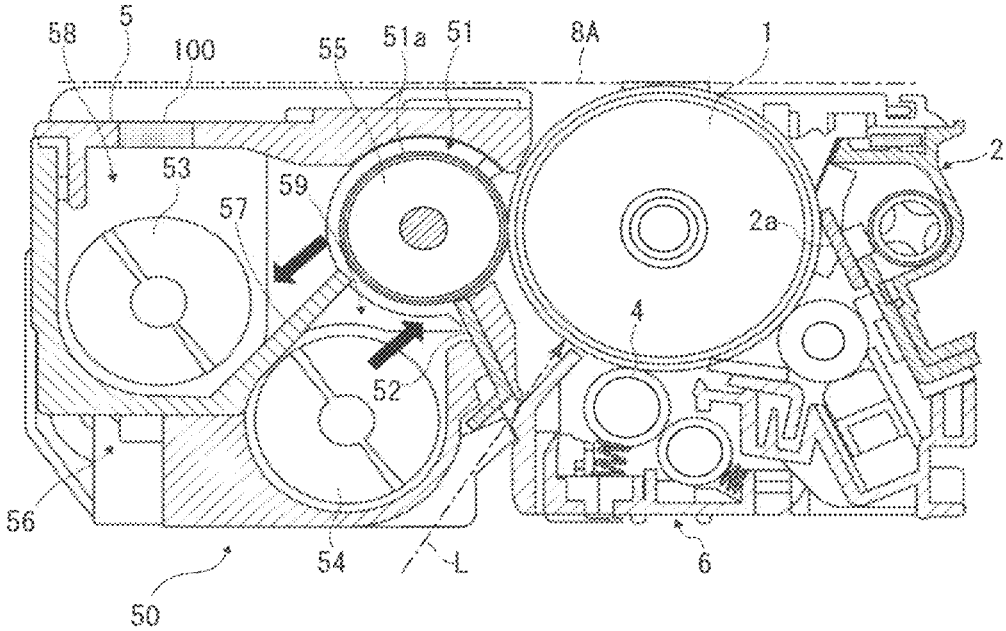
FIG. 2 is a figure for illustrating a constitution of the process cartridge composing the image-forming section in FIG. 1.

In addition, the four image-forming sections 6 (6Y, 6M, 6C and 6Bk), provided in the body 10 of the copying machine, have almost the same structure except for its toner color (yellow (Y), magenta (M), cyan (C) and black (Bk)) used for an image-forming process for example. These structures are as shown in FIG. 2. Alphabetical references (Y, M, C and K) assigned to the image-forming sections 6, the photoreceptor drums 1 and first-transfer bias rollers 9 respectively are abbreviated in FIG. 2.

Figure 6:
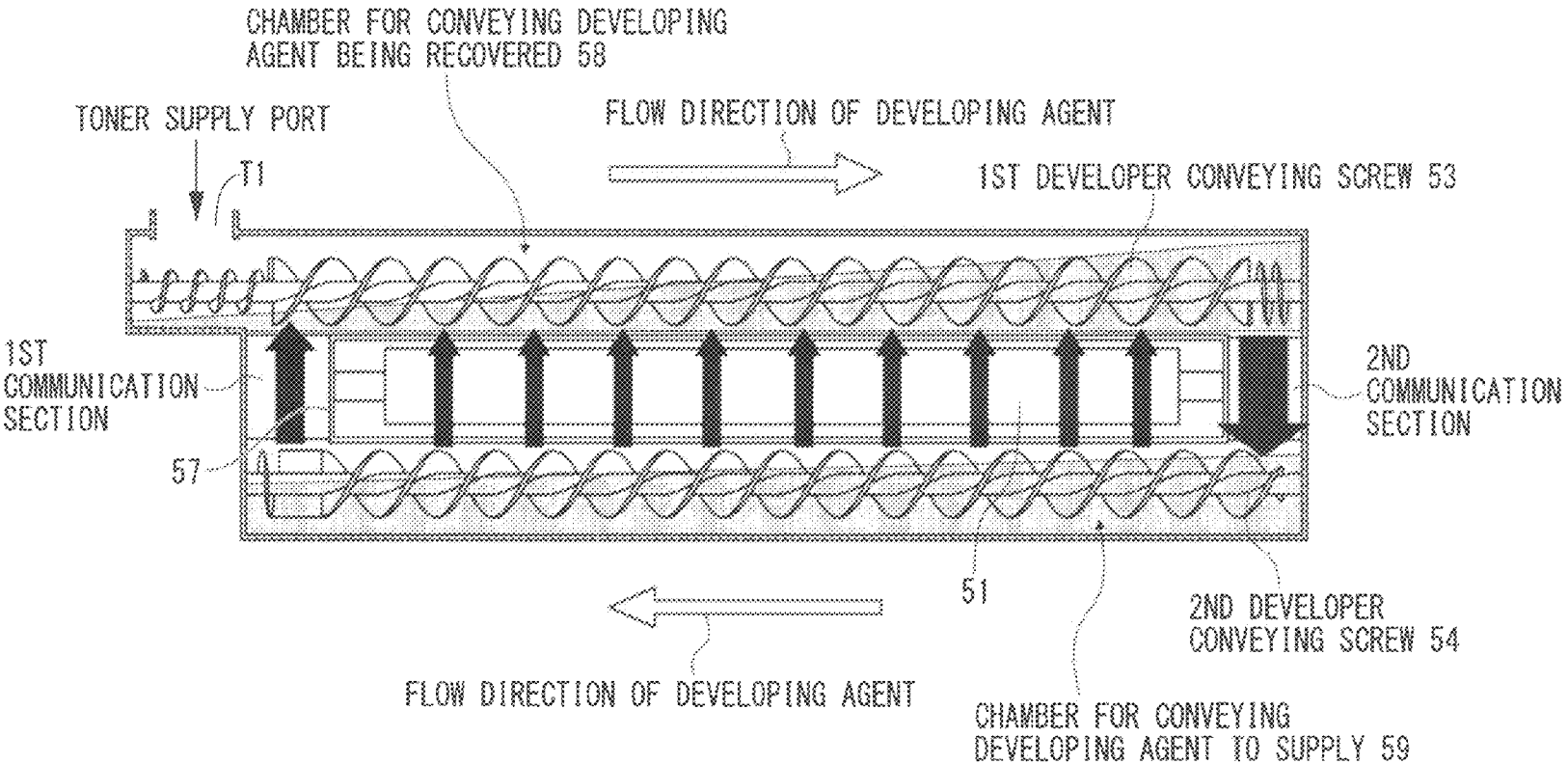
FIG. 6 is a figure for illustrating a circulation condition of the developing agent in two chambers of the developing apparatus in FIG. 3.

The image-forming sections 6 in FIG. 6 have the photoreceptor drums 1 as the image carrier, a charge section (charging device) 4 provided in around each of the photoreceptor drums 1, the developing apparatuses 5 as a developing section, and a cleaning section 2 (cleaning device) (In FIG. 1, only the developing apparatuses 5 are shown) and so on.

The image-forming process (a charging step, an exposing step, a developing step and a cleaning step) is (are) carried out on each of the photoreceptor drums 1 respectively, and an intended toner image is formed on each of the photoreceptor drums 1 respectively.

Each of the photoreceptor drums 1, the charge part 4, each of the developing sections (developing apparatuses) 5 and the cleaning section 2 constitute each of the image-forming sections 6, and are provided in each of the process cartridges, and each of the process cartridges is composed of units capable of being housed together. Each of the process cartridges is configured to be able to be set on the body of the image-forming apparatus 100 in a detachable state. When it comes to the end of the cartridge's life, the process cartridge is replaced with a new one.

In this way, since the process cartridge is provided in the body of the image-forming apparatus 100 in a detachable state, this improves in which leads to improve in workability when doing maintenance of the image-forming sections 6, makes it easy to carry out the replacement, and improves recycling efficiency.

Normal movements in forming a color image of the image-forming apparatus shown in FIG. 1 will be explained below. In addition, the image-forming process, which is carried out on the photoreceptor drums 1Y, 1M, 1C and 1Bk of image-forming sections 6Y, 6M, 6C and 6Bk by the color (yellow (Y), magenta (M), cyan (C) and black (Bk)), will be explained by referring also to FIG. 2.

To begin with, a manuscript on a pedestal of the image-forming apparatus 100 is conveyed over to a contact glass of the image reading section 32 by conveying rollers of the feed section not shown in the figures. After this, the image reading section 32 optically reads the image information of the manuscript placed on the contact glass.

In more detailed, the image reading section 32 scans the image of the manuscript on the contact glass by irradiating it with light emitted from an illumination lamp, not shown in the figures.

After this, the light that has been reflected on the manuscript goes thorough mirrors and lenses, and forms the image on a color sensor. The color image information of the manuscript is read by the color sensor with respect to each color separation light of RGB (red, green and blue), and is converted to electric image signals.

In addition, treatments such as a color conversion process, color correction process, spatial frequency correction and so on are carried out in an image-processing section based on the electric image signals, and color image information of yellow, magenta, cyan and black is obtained.

The image information in each color of yellow, magenta, cyan and black is transmitted to an exposure unit (not shown in the figures), the exposure unit being composed of an optical writing device of a scanning-type of using laser light for example. Laser light L (FIG. 2) based on the image information of the colors respectively is emitted toward the surfaces of the photoreceptor drums which correspond to the light, respectively.

On the other hand, the four photoreceptor drums 1Y, 1M, 1C and 1BK are rotated clockwise as shown in FIG. 1, respectively. Firstly, the surfaces of the photoreceptor drums 1Y, 1M, 1C and 1BK are charged uniformly by the portions facing against the charge part 4, respectively (Charging step).

In this way, charged potentials are formed on the photoreceptor drums 1Y, 1M, 1C and 1BK. After that, the charged surfaces of the photoreceptor drums 1Y, 1M, 1C and 1BK move round to a radiation position by the laser light L emitted from the exposure unit (not shown in the figures), and latent images are formed by scanning exposures in the position, respectively (Exposure step).

More specifically, in the exposure unit, laser light L corresponding to the image signals is emitted from four light sources by corresponding to the colors respectively. The laser light L passes through different optical paths for each color component of yellow, magenta, cyan and black.

One the laser light L corresponding to yellow irradiates the surface of the photoreceptor drum 1Y located first from the left in FIG. 1. By this, the laser light is reflected by a polygon mirror rotating at high speed, and scans the surface in a direction (main scanning direction) of an axis of rotation of the photoreceptor drum 1 Y. In this way, the photoreceptor drum 1Y is charged and an electrostatic latent image corresponding to the yellow color component is formed on the photoreceptor drum 1Y.

In the same way, the laser light L corresponding to the magenta color component irradiates the surface of the photoreceptor drum 1M located second from the left in FIG. 1, and an electrostatic latent image corresponding to the magenta color component is formed on the photoreceptor drum 1M.

The laser light L corresponding to the cyan color component irradiates the surface of the photoreceptor drum 1C located third from the left in FIG. 1, and an electrostatic latent image corresponding to the cyan color component is formed on the photoreceptor drum 1C.

The laser light L corresponding to the black color component irradiates the surface of the photoreceptor drum 1BK located fourth from the left in FIG. 1, and an electrostatic latent image corresponding to the black color component is formed on the photoreceptor drum 1BK.

After that, the surfaces of the photoreceptor drums 1Y, 1M, 1C and 1BK, where the electrostatic latent images by the colors have been formed respectively, move around to positions facing the developing apparatuses 5Y, 5M, 5C and 5Bk, respectively.

Each color toner is supplied from the developing apparatuses 5 to the surfaces of the photoreceptor drums 1Y, 1M, 1C and 1BK respectively, and the electrostatic latent images on the photoreceptor drums 1Y, 1M, 1C and 1BK are developed respectively (Developing step).

After that, the surfaces of the photoreceptor drums 1Y, 1M, 1C and 1BK after the developing step, move round to positions facing the intermediate transfer belt 8A, respectively. In these positions, first transfer bias rollers 9Y, 9M, 9C and 9BK are provided respectively in a condition such that the first transfer bias rollers face an inner peripheral surface of the intermediate transfer belt 8A.

After that, the toner images are sequentially put and transferred onto the intermediate transfer belt 8A one by one, in the positions of the first transfer bias rollers (First transfer step).

In this way, residual toners which have not been transferred remain on the photoreceptor drums 1Y, 1M, 1C and 1BK slightly.

After the first transfer step, the surfaces of the photoreceptor drums 1Y, 1M, 1C and 1BK move around to positions facing the cleaning sections 2, 2, 2 and 2 respectively (see FIG. 2). After that, the residual toners on the photoreceptor drums 1Y, 1M, 1C and 1BK are recovered by cleaning blades 2*a*, 2*a*, 2*a* and 2*a* and so on of the cleaning sections 2, 2, 2 and 2, respectively.

After that, the surfaces of the photoreceptor drums 1Y, 1M, 1C and 1BK move around to positions facing neutralizing sections (not shown in the figures), and residual potentials on the surfaces of the photoreceptor drums 1Y, 1M, 1C and 1BK are removed in these positions. In this way, a set of image-forming processes in the photoreceptor drums 1Y, 1M, 1C and 1BK are finished.

The image-forming processes above are carried out in the four image-forming sections, 6Y, 6M, 6C and 6BK respectively. That is to say, by referring to FIG. 1, the laser light L based on the image information is emitted from the exposure unit arranged under the image-forming sections respectively, and irradiated toward the surfaces of the photoreceptor drums 1Y, 1M, 1C and 1BK of the image-forming sections, 6Y, 6M, 6C and 6BK respectively.

More specially, the exposure units make the laser light L be emitted from the light sources, scanning with the laser light L is performed by using the polygon mirror rotation driven, and irradiates on the surfaces of the photoreceptor drums 1Y, 1M, 1C and 1BK through a plurality of optical elements.

After that, the toner images by the colors, which have been formed on the photoreceptor drums 1Y, 1M, 1C and 1BK through the developing step above, are put and transferred on the intermediate transfer belt 8A. In this way, a color image is formed on the intermediate transfer belt 8A.

The four first transfer bias rollers 9Y, 9M, 9C and 9K and the photoreceptor drums 1Y, 1M, 1C and 1BK form first transfer nips respectively, by binding the first transfer belt 8A. Transfer biases with the inverse polarity of the toner are applied on the first transfer bias rollers 9Y, 9M, 9C and 9K, respectively.

After that, the intermediate transfer belt 8A travels in a direction of the arrow in the FIG. 1, and passes through first transfer nips of the first transfer bias rollers 9Y, 9M, 9C and 9K one by one. In this way, the toner images by the colors on the photoreceptor drums 1Y, 1M, 1C and 1BK are put and first-transferred onto the intermediate transfer belt 8A, respectively.

After that, a portion of the intermediate transfer belt 8A, onto where the toner images by the colors are put and transferred, travels to a position facing a second-transfer roller 19. In this position, second transfer back-up roller 12 and the 2nd-transfer roller 19 form a second transfer nip by binding the first transfer belt 8A.

The color toner image on the intermediate transfer belt 8A is transferred onto a recording medium P such as transfer paper and so on, which has been conveyed to the second transfer nip position. In this way, residual toner remains on the intermediate transfer belt 8A, and is not transferred to the record media P. The residual toner remaining on the first transfer belt 8A is removed by a belt-cleaning unit not shown in the figures, and the first transfer belt 8A is restored to its initial state.

In this way, a set of transferring processes on the intermediate transfer belt 8A are finished.

In this, the record medium P is one that has been conveyed to the second transfer nip position from the paper feed section 26 that is provided under the image-forming apparatus 100 via the paper feed roller 27 and a pair of the registration rollers 28 and so on.

More specifically, recording media P such as transfer papers and so on are stacked and housed inside of the paper feed section 26. Once the paper feed roller 27 has been rotary driven in the counter-clockwise direction in FIG. 1, a recording medium P on the top of the stack is conveyed toward between a pair of the registration rollers 28.

The recording medium P which has been conveyed to a pair of the registration rollers 28, is stopped at a nipping position by a pair of the registration rollers 28. A pair of the registration rollers 28 is rotary driven focusing on timing the color image on the intermediate transfer belt 8A. The record medium P is conveyed to the second transfer nip position. In this way, an intended color image is transferred onto the recording medium P.

After that, the recording medium P onto which the color image is transferred at the second transfer nip, is conveyed to a position of the fixing device 20. The transferred color image on the recording medium P is fixed on it by heat and pressure of a pressure roller and a fuser roller in this position.

After that, the recording medium P is ejected outside of the image-forming apparatus 100 between a pair of ejection rollers 29. The recording medium P ejected outside of the image-forming apparatus 100 is stacked on the catch tray 30 one by one.

In this way, a set of image-forming processes in the image-forming apparatus 100 is finished.

Next, a configuration embodiment of the developing apparatus 5 of the image-forming section in FIG. 2 will be explained more specifically.

FIG. 2 shows a schematic cross-section of the process cartridge used in the image-forming section 6. The process cartridge is one able to be detachably set on the image-forming sections 6Y, 6M, 6C and 6Bk by the colors in FIG. 1 respectively.

The developing section (developing apparatuses) 5 has: a developing device (casing) 50; a developing roller 51 (developing agent bearing member), being provided in this developing section 50, facing photoreceptor drums 1; a blade 52 (developing agent control member), being arranged under the developing roller 51; a chamber for conveying the developing agent to a supply 59 (developer supply unit), being composed of a space which is arranged in a longitudinal direction of the developing device (casing) 50; a chamber for conveying the developing agent being recovered 58 (developer recovery unit), being composed of a space which is arranged in a longitudinal direction of the developing device (casing) 50; a first developer conveying screw below 53 (first developer conveying member), being composed of a screw member provided in the chamber 59; and, a second developer conveying screw below 54 (second developer conveying member), being composed of a screw member provided in the chamber 60.

Two-component developing agent composed of toner and its carrier is housed in the chambers 58, 59. Toner in the developing agent according to the present embodiment has shape factor SF-1 in a range of 100 to 180 and has shape factor SF-2 in a range of 200 to 180.

A toner concentration sensor 56 to detect the toner concentration is provided in a position facing the second developer conveying member 54 of the developing device 50. In addition, the first developer conveying member 53 of the two conveying screws is a recovery screw as a recovery conveyance member that faces the developing roller 51 and mixes a makeup toner and the developing agent which has been detached from the developing roller 51.

The second developer conveying member 54 of the two conveying screws is a supplying screw as a supply conveyance member that is provided approximately under the developing roller 51 while facing this roller, and supplies the developing agent to the developing roller 51 while conveying the developing agent in the longitudinal direction of the developing device 50.

The first developer conveying member 53 and the second developer conveying 54 are set in the opposite direction of rotation, so that they convey the developing agent in the opposite direction, and circulate the developing agent in the direction perpendicular to the paper surface of FIG. 2.

Figure 3:
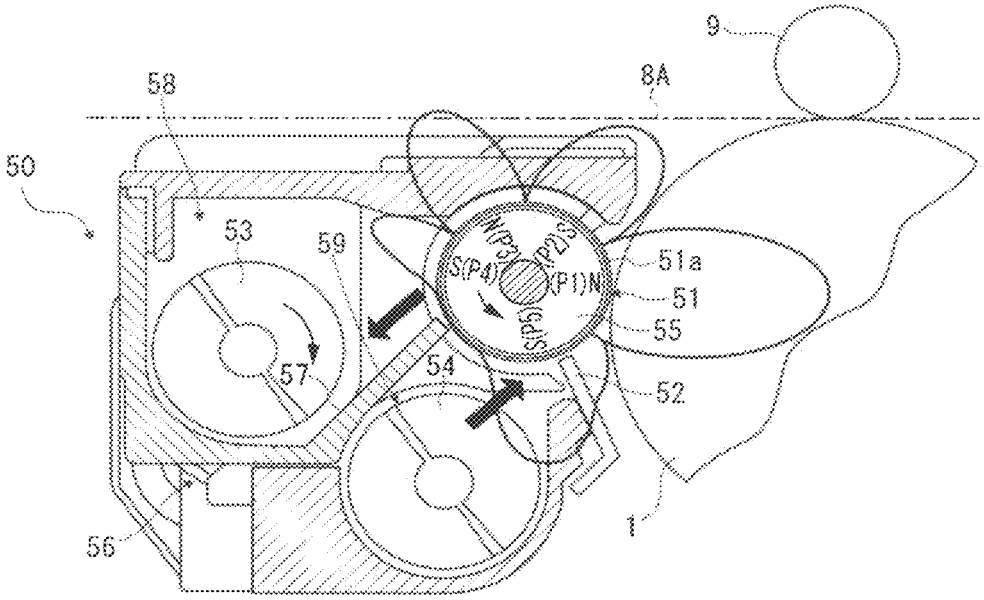
FIG. 3 is a figure for illustrating a skeleton framework of the developing apparatus used in the process cartridge in FIG. 2.
Figure 4:
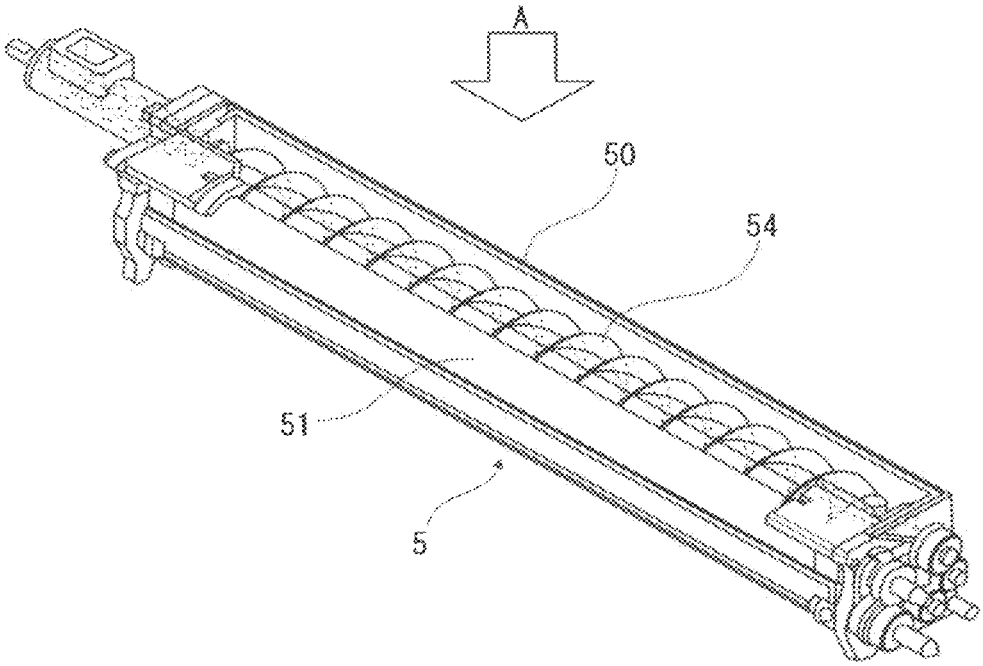
FIG. 4 is a perspective view depicting the main body of the developing apparatus in FIG. 3.

FIG. 3 is a schematic cross-sectional view for illustrating a condition of supplying and recovering the developing agent in the developing apparatuses 5. FIG. 4 shows a perspective view of the developing apparatus in FIG. 3.

The base configuration of this developing apparatus 5 is the same as one that is built in the image-forming sections (process cartridge) 6 in FIG. 2. As shown in FIG. 3, the developing roller 51 is composed of a magnetic roller 55 with a plurality of magnetic poles provided inside the solid, a developing sleeve 51*a* to rotate around the magnetic roller 55, and so on.

For example, five magnetic poles P1 to P5 are formed in the magnetic roller 55 of the developing roller 51. With the developing sleeve 51*a* rotating around the magnetic roller 55 in which the five magnetic poles P1 to P5 are formed, the developing agent is moves on the developing roller 51 (on the developing sleeve 51*a*) in accordance with the rotation.

In addition, curve lines in a radial fashion on the magnetic roller 55 of the developing roller 51 in FIG. 3 show each magnetic field area (magnetic force area) of the magnetic poles P1 to P5.

The magnetic pole P1 is a magnetic pole to form a magnetic brush of the developing agent in a developing area. The magnetic pole P2 is a pole to convey the developing agent. The magnetic pole P3 is a pre-pole to detach the developing agent from the developing roller 51. The magnetic pole P4 is a pole to detach the developing agent from the developing roller 51. The magnetic pole P5 is a pole to abstract the developing agent.

In FIG. 3, although the magnetic roller 55 has five magnetic poles P1 to P5 formed, the number of the magnetic poles is not limited to five, for example four, six or another number are allowed. The fixed magnets can also be arranged instead of the magnet roller 55. The magnetic poles P1 to P5 in FIG. 3 are one example. It is also possible to reverse these N and S poles.

Next, a configuration example of one-way circulation developing will be explained below.

The developing apparatus 5 in FIG. 3 has: the developing roller 51; the blade 52; the first developer conveying member 53; the chamber 58, housing the first developer conveying member 53; the second developer conveying member 54; the chamber 59, housing the second developer conveying member 54; and a shielding member 57, shielding and separating the two spaces of the chambers 58, 59.

In each of the chamber 58 and the chamber 59 inside of the developing device (casing) 50 of the developing apparatus 5, the developing agent contains 7% by weight of a homogenized mixture of a toner (particle diameter=5.8 micrometers) with polyester resin in the major proportions and a toner carrier as magnetic micro-particle (particle diameter=3.5 micro meters). A certain amount of the developing agent (eg. 300 g) is filled in the chambers 58, 59.

By rotating the first and second developer conveying screws 53, 54 at a certain rotation speed (eg. 600 r.p.m) that are arranged in parallel, a makeup toner which has been fed to the chambers is mixed and conveyed at the same time to homogenize and charge the toner.

The homogenized developing agent is mixed and conveyed along a direction of axis which corresponds to the longitudinal direction by the second developer conveying member 54 which is provided close to and parallel to the developing sleeve 51*a* of the developing roller 51, and conveyed to the peripheral surface of the developing sleeve 51*a* by magnetic forces of the magnetic poles P4, P5 of the magnet roller 55 included in the developing sleeve 51*a*.

By rotating the developing sleeve 51*a* in a rotation direction shown by arrows in the figures, the developing agent is conveyed to the developing area made of the photoreceptor drum 1 and the developing sleeve 51*a*, and the toner develops the latent image on the photoreceptor drum 1 by forming the development field by a high voltage power supply not shown in the figures.

Since it is set so that the developing agent after the development is recovered to the inside of the developing device (casing) 50 along with the rotation of the developing sleeve 51*a*, this developing agent is recovered to the first developer conveying member 53 via a shielding member 57.

FIGS. 5A-1, 5A-2 and 5B are views in the direction of arrow A in FIG. 4, in which walls of the developing device (casing) 50 are abbreviated in FIGS. 5A-1, 5A-2 and 5B.

Figures 1, 5A:
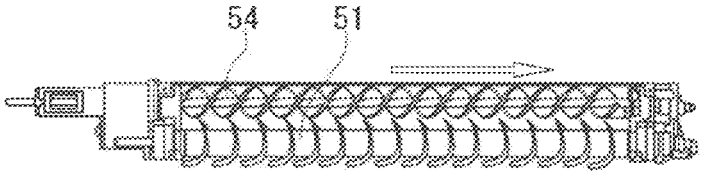
Figures 2, 5A:
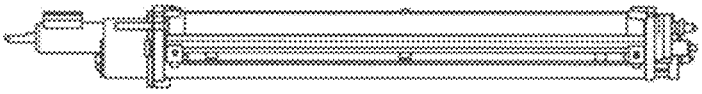
Figure 5B:
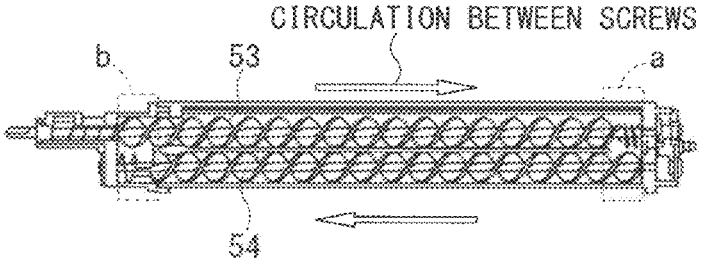

In FIGS. 5A-1 and 5B, the arrow shows the movement direction of the developing agent, and a figure signed by "(A-1)" shows the movement direction in the first developer conveying member 53 in a case where the developing agent is recovered toward the first developer conveying member 53 inside of the chamber 58 via the developing sleeve 51*a*. A figure signed by "(A-2)" shows a front view of (A-1).

FIG. 5B shows the movement direction of the developing agent by the first and second developer conveying screws 53, 54 in the chambers 58, 59. In FIG. 5B, the chamber 59 communicates as first and second communication sections with the bottom of the chamber 58 in regions a, b of the ends of the screws 53, 54, and inside the chambers 58, 59 the developing agent is mixed and conveyed by the screw 53 to recover in an upper position and the screw 54 to supply in the lower position.

It is set so that the developing agent is conveyed from top to bottom in the region a, and is conveyed from bottom to top in the region b. The screw geometry around in the communication sections is a paddle-shape or a screw-shape with rolling up in the reverse direction, which enables the developing agent to be conveyed in a direction vertical to the conveying direction.

FIG. 6 is a schematic cross-sectional view showing the movement of the developing agent in a longitudinal direction of the developing apparatus 5 shown in FIGS. 3 and 4. As shown in FIG. 6, it is carried out to convey the developing agent as shown by the bold arrow in the chamber 59, and the developing agent being conveyed by the screw 54 is abstracted to the developing sleeve 51*a* by the magnetic force of the developing roller 51.

The developing agent after the development leaves the surface of the developing sleeve 51*a* of the developing roller 51 via the shielding member 57 and is conveyed into the chamber 58 on the side of the screw 53. The two chambers 58, 59 communicate with each other by cutting out a portion off the shielding member outside of the development area of the developing roller 51.

The developing agent not used in the development is conveyed by the screw 54, and passed into the chamber 58 on the side of the screw 53 through the communication section (second communication section) on the downstream side in the conveyance direction of the screw 54.

In the chamber 58 where the screw 53 is provided in, a toner supply port T1 is formed in a lateral position of wings of the screw 53 as shown in FIGS. 4 and 6, the toner is supplied into the chamber 58 via the toner supply port T1, and mixed with the developing agent passed from the screw 54 and conveyed by being mixed. The developing agent mixed and conveyed by the screw 53 is mixed with the developing agent recovered from the developing roller 51 after the development, and is conveyed in the same way.

The developing agent mixed and conveyed by the screw 53 is passed to the chamber 59 with the screw 54 being arranged at the communication section (second communication sections) on the downstream side of the conveyance direction of the chamber 58.

In this way, in the developing apparatus 5 according to the present invention, the developing agent is conveyed in one-way circulation by the screws 53, 54, and the supply to the developing roller 51 and the recovery from the developing roller 51 and the toner supply are carried out in the course of the conveyance.

Technical features according to the present invention by targeting the developing apparatus having the above-mentioned configuration are described below.

Figure 7:
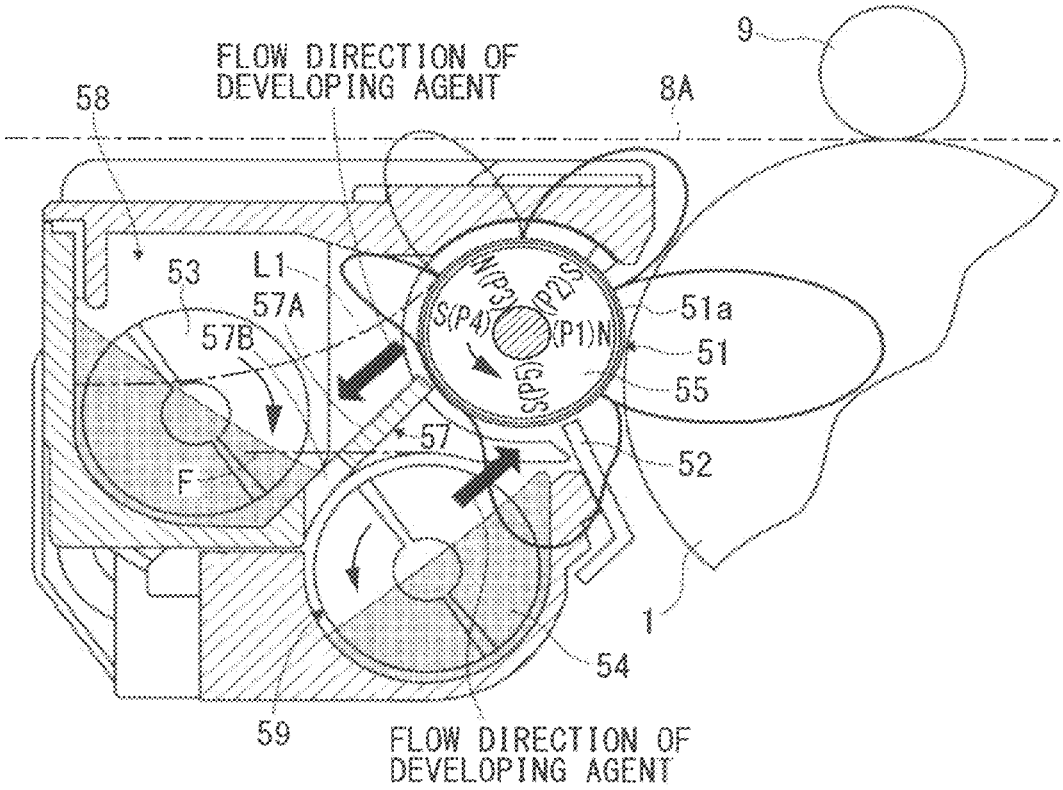
FIG. 7 is a figure for illustrating the technical feature in an embodiment of the developing apparatus according to the present invention.

FIG. 7 is a figure for explaining one embodiment of the developing apparatus according to the present invention, which corresponds to FIG. 3. FIG. 7, in the shielding member that is separates the chambers 58 and 59, the third communication sections 59B are provided next to a guide section 57A which guides the developing agent recovered from the developing roller 51 toward to the screw 53, apart from communication sections (first and second communication sections) provided out of the development area of the conveying screws (signed by "a" and "b" in FIG. 5B).

In FIG. 7, the edge section of the shielding member 57 that faces the developing sleeve 51*a*, is arranged in an approximate center position between the magnetic poles P4 and P5 of the poles P1 to P5 included in the developing sleeve 51*a*, where lines of magnetic force of the magnetic poles P4 and P5 are in a relationship of repelling each other.

The guide section 57A to receive the developing agent which has left and been scattered from the developing sleeve 51*a* and guide this toward to the screw 53, is provided on the side of the edge section of the shielding member 57.

The shielding member 57 tilted in such a way that its portion facing the wings of the screw 53 is arranged below the level of the edge, in order to guide the developing agent which has left and been scattered from the developing sleeve 51*a* toward the screw 53 of the chamber 58 by self-weigh dropping of the developing agent.

In addition to the guide member 57A above, along with the recovery direction of the developing agent (direction of arrow shown as developer circulation direction in the figures), by corresponding to positions in a direction away from the edge section along with the recovery direction, the third communication sections 57B composed of penetrating holes are provided next to one another in the shielding member 57.

By locating the guide section 57A at the approximate center position between the magnetic poles repelling each other, it is possible to keep a performance of trapping the developing agent which has left and been scattered from the developing sleeve 51*a*. The developing agent is recovered and conveyed toward the downstream of the developer moving direction, and a portion of this developing agent travels to down the slope to the chamber 59 through the 3rd communication sections 57B.

Herewith, it is possible to continue the recovery of the developing agent by preventing it from being saturated due to an increase in the level of the developing agent on the downstream of the developer moving direction.

A mesh member (foreign object capture member) (not shown in the figures) is arranged at an opening on the side of the chamber 58 of the third communication sections 57B in order to prevent foreign objects from being incorporated into the chamber 59 via the opening. With this mesh arrangement, it is possible to prevent the foreign objects from being attached to the developing roller 51, and to prevent it from generating an abnormal image portion such as white lines and so on in a formed image.

Figure 8:
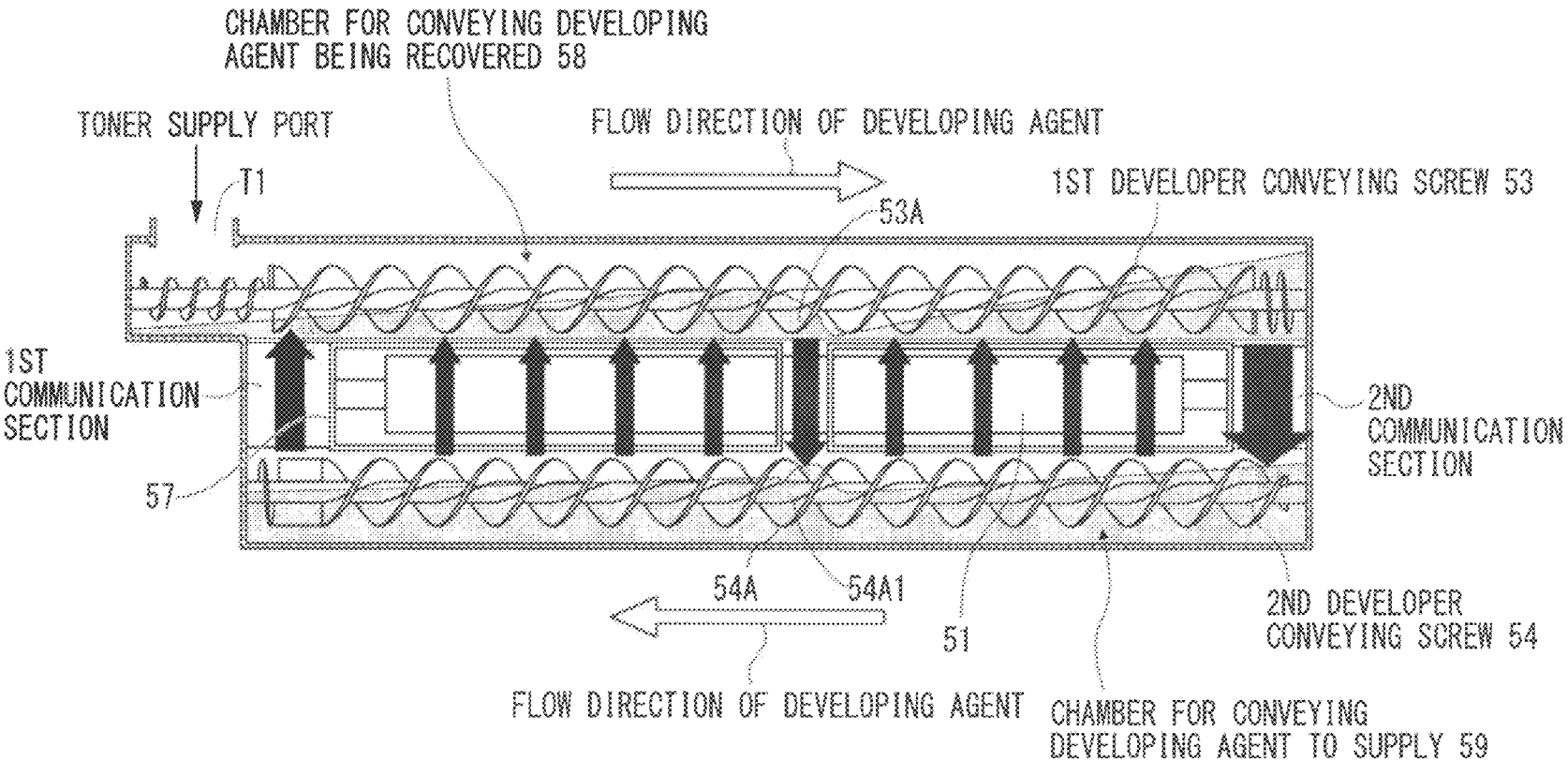
FIG. 8 is a figure for illustrating the circulation condition of the developing agent with the technical feature in FIG. 7.

The third communication sections 57B are at least provided between from the center position to the communication section (second communication section) on the downstream side in the conveyance direction of the developing agent by the screw 53, as shown in FIG. 8.

FIG. 8 shows an example in which the third communication section 57B is provided at approximately the center position in the conveyance direction of the developing agent.

As shown by a dashed-dotted line F in FIG. 7, the third communication section 57B is provided by forming openings in location positions of the shielding member 57 which correspond to a time position after the developing agent which has moved by the guide section 57A of the shielding member 57 begins to contact the wings of the screw 53, in the recovery direction of the developing agent (direction of arrow shown as developer circulation direction in FIG. 7).

Herewith, a portion of the developing agent, which has been mixed in a condition capable of contacting with the wings of the screw 58, is able to flow into the chamber 59, instead of the developing agent, which has been recovered from the developing sleeve 51*a*, flows into the chamber 59 directly. As such, it is possible to prevent a degradation of an image density by preventing a deficient charge which occurs when the developing agent without a triboelectric charging in mixing flows into the chamber 59.

In addition, the third communication sections 57B are formed with their opening area being set based on the next condition. That is to say, the opening area is set smaller than an opening area of the communication section (second communication section, located in the region signed by "a" in FIG. 5B) on the downstream side in the conveyance direction of the developing agent by the screw 53.

In other words, the opening area is set to be able to let an amount of the developing agent which corresponds to an increased level of the developing agent unrecoverable on the downstream side in the conveyance direction of the developing agent, and to pass into the chamber 59 on the upstream side.

Herewith, it is possible to prevent toner concentration deviation from increasing on the downstream side in the conveyance direction of the developing agent.

In such a configuration as above, it is possible to prevent short supply of the developing agent and to prevent the developing agent from being unrecoverable. In summary, this embodiment is carried out supply of the developing agent to the developing sleeve 51*a* while mixing and conveying the developing agent by the screw 54.

Since it adopts a scheme of recovering all to the screw 53, an accumulated condition of the developing agent is tilted (the volume of the developing agent in the chamber 58 is lower toward the communication section (second communication section)).

Setting a developer conveyance performance obtained from the diameter of the screw 54, the pitch thereof and the number of rolling up of the screw wings as "Wm", and a volume of the developing agent being conveyed onto the developing sleeve 51*a* as "Ws", if this relationship is Wm>Ws, the developing agent can be conveyed and uniformly deposited onto the developing sleeve 51*a*.

If the condition Wm>Ws is not satisfied, it results in a quantitative deficiency of the developing agent on the downstream side in the conveyance direction of the developing agent by the screw 54, and it becomes impossible to supply the developing agent to the developing sleeve 51*a*.

In the same way, the developing agent recovered from the developing sleeve 51*a* to the screw 53 is at a high level on the downstream side in the conveyance direction of the developing agent, so that if the recovery of the developing agent is saturated there, which results in unrecovered developing agent invading into the screw 54 side through an aperture between the shielding member 57 and the developing sleeve 51*a*, this developing agent fails to be supplied to the developing nip again without being mixed by the screw 54 thoroughly.

To prevent a phenomenon like this, it is necessary to set the numbers of rotations of the screws 53, 54 superior to the volume of the developing agent being conveyed onto the developing sleeve 51*a*. Inevitably the screws 53, 54 are set in high rotation, which results in new problems such as a generation of friction heat in the developing agent, increase in a drive load for the rotation and so on.

In contrast, the present embodiment it is set such that a portion of the developing agent moves to the chamber 59 via the third communication section 57B, where the developing agent moves toward the downstream side in the conveyance direction of the developing agent by the screw 53 in the chamber 58.

By this, it is possible to reduce a volume of the developing agent that moves toward the downstream side in the conveyance direction of the developing agent in the chamber 58, and to prevent the level of the developing agent from being at a high level on the downstream side in the conveyance direction of the developing agent, and to prevent an unrecoverable state of the developing agent in the chamber 58.

In addition, the developing agent moving to the chamber 59 via the third communication section 57B moves in a condition of being mixed by contacting the screw wings of the screw 53, so that it is possible for the developing agent to move while carrying out a triboelectric charging of the developing agent.

In addition, because the developing agent can be prevented from being at a high level on the downstream side in the conveyance direction of the developing agent, it is possible to prevent unrecovered developing agent being carried together with a rotation of the developing sleeve 51*a* when the recovery of the developing agent is saturated, and which enables prevention of deviation of the toner density compared to the toner density of the developing agent supplied to the developing sleeve 51*a*.

In the present embodiment, the third communication sections 57B are provided next to the guide section 57A of the shielding member 57 to guide the developing agent, whereby the guide section 57A lets the developing agent to do self-weight-dropping on the shielding member 57, so that it doesn't need a configuration to forcibly move the developing agent toward to the communication section and so on, for example, as in a shielding member with a communication section in JPA2002-148927.

In summary, the literature differs in the circulation scheme from the present embodiment, and it discloses a configuration to enlarge the axis of a conveying screw partially which corresponds to the communication section of the shielding member, in the direction of the conveying screw to lift up and move a developing agent into the communication section, but which leads to small wings of the conveying screw and results in a risk of a decrease in conveying volume due to reduced areas of the screw wings.

In the present embodiment, the developing agent which has been removed and scattered from the developing sleeve 51*a* is directly guided by the guide section 57A, and it allows the developing agent to navigate from the chamber 58 toward the chamber 59 just by letting the developing agent to the third communication sections 59B, so that is no need to cause a reduction in the conveying volume and to have a special mechanism.

Furthermore, the third communication sections 59B are provided in association with positions of the screw wings of the conveying screws 53, 54, therefore because it is possible to navigate the developing agent toward where the screw wings 54A of the screw 54 do not exist in the chamber 59, it is possible to navigate smoothly the developing agent without being disturbed by the screw wings rotations.

In addition, it is possible to prevent the developing agent from being high level on the downstream side in the conveyance direction of the developing agent in the chamber 58, so that it is possible to carry out one-way circulation without increasing a rotation speed of the screw 53; as this result, it is possible to prevent an increase in the driving load and a degradation of the developing agent due to friction heat, which are caused by increasing the rotation speed of the screw 53.

Figure 9:
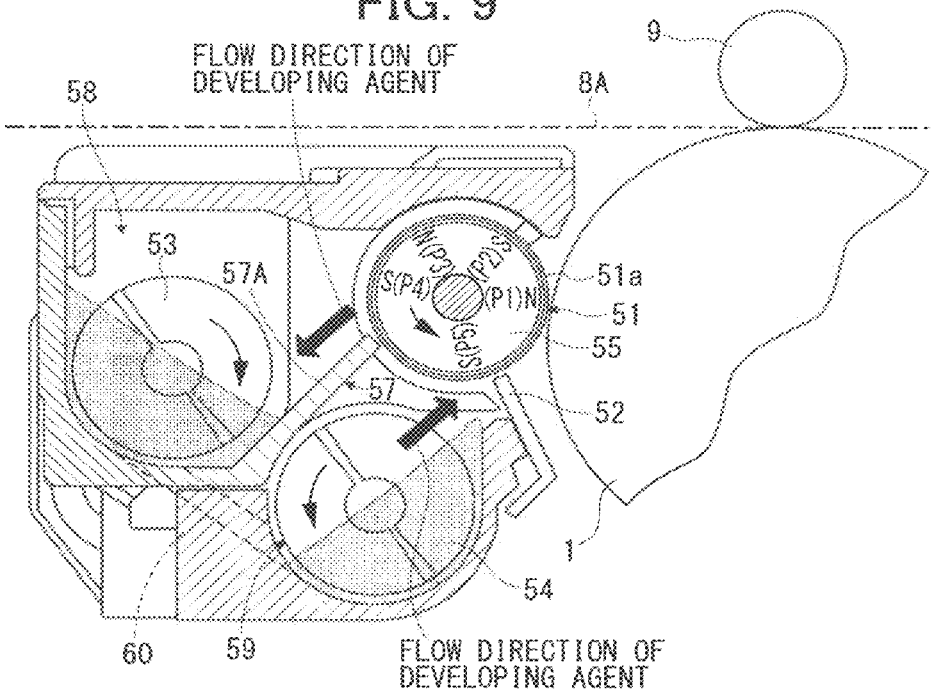
FIG. 9 is a figure corresponding to FIG. 3, for illustrating an embodiment having a critical portion modified from one in FIG. 3.

Next, a modification embodiment will be explained as follows. FIG. 9 shows a configuration of a third communication section provided between bottoms of the chambers 58, 59 by communicating the bottoms of the chambers 58, 59, instead of being provided in the shielding member 57.

In FIG. 9, the third communication sections (denoted by a numeral sign 60 for convenience) are composed of flow paths along with the tangent of the screws 53, 54 which are arranged in the chambers 58, 59 respectively in a vicinity of the bottoms of the chambers 58, 59.

In addition, as shown in FIG. 8 used in the explanation of the previous embodiment, one end of the flow path of the third communication section 60 is in a position facing the screw wing 53A of the screw 53 in the chamber 58, and the other one end of the flow path of the third communication sections 60 is in a position not facing the screw wing 54A of the screw 54 in the chamber 59, that is to say, a position facing an axis portion 54A1 of the screw 54.

With this configuration, when the developing agent flows down through the third communication section 60, the developing agent is pushed by the screw wing 53A of the screw 53 to a preferable condition to introduce into the flow path in the chamber 58. In the chamber 59, the developing agent flowing out from the flow path is in a condition of hardly contacting the screw wing 54A of the screw 54, so that introduction of the developing agent into the chamber 59 is easier.

Figure 10A:
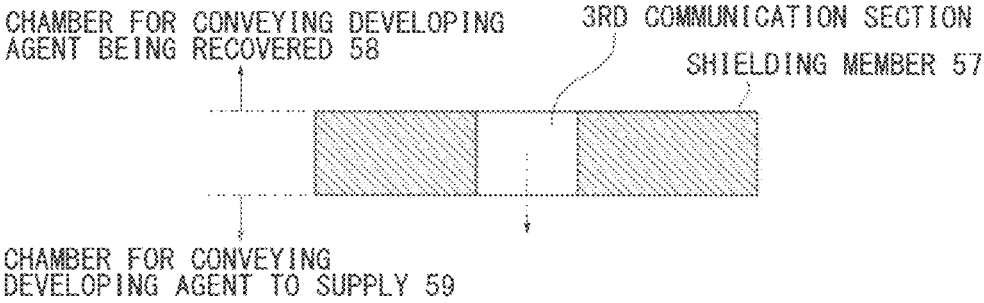
FIGS. 10A and 10B are figures for illustrating a modified embodiment relevant to the third communication section used in the developing apparatus in FIG. 3.
Figure 10B:
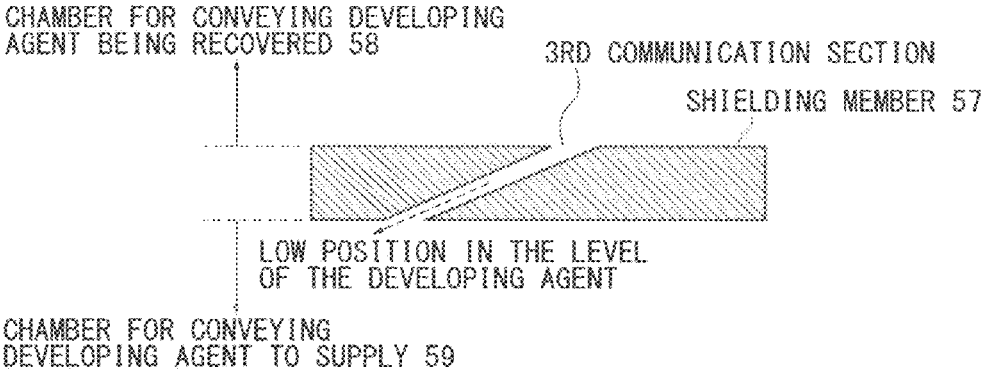
Figure 11:
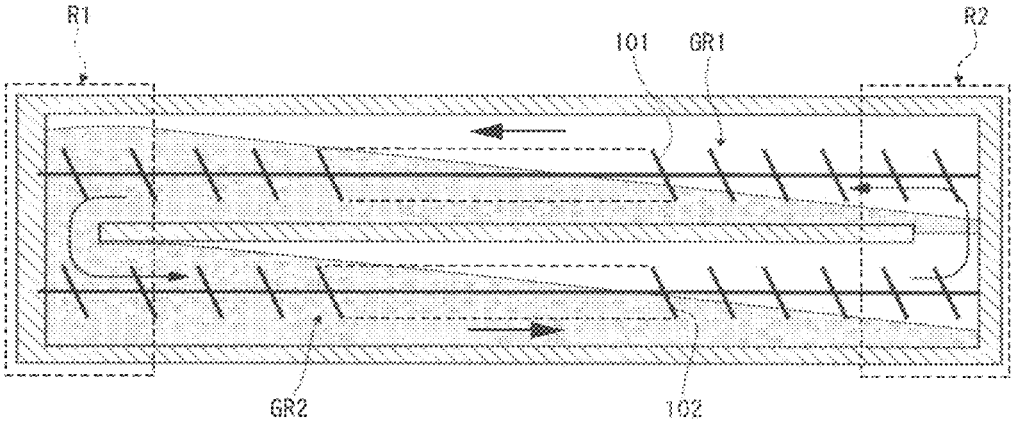
FIG. 11 is a figure for illustrating a circulation condition of the developing agent in a related art.

Also, as to the configurations of the third communication section which are shown in the above embodiments, especially as to the configuration of the third communication section provided in the chamber 57, it is not limited to just a penetration hole as shown in FIG. 10A, but for example, it is acceptable to have a directional penetration hole with its shape having a direction in introducing the developing agent to the chamber 59, as shown in FIG. 10B.

In a case of the shape shown in FIG. 10B, by setting the shape in a direction toward to a position which likely causes a low level of the developing agent and lack of the developing agent in the chamber 59, it is possible to normalize the level in the chamber 59 to prevent a concentration deviation and lack of the developing agent.

What is claimed is:

1. A developing apparatus for storing a developing agent which contains a toner and a carrier, and which develops a latent image on a latent image carrier with said toner, comprising:

a developing agent-bearing member, facing said latent image carrier, with magnetic poles formed around;

a developing agent control member, arranged under said developing agent-bearing member while facing this member, to control a volume of said developing agent on said developing agent-bearing member;

a developer recovery unit, arranged at an upper position of a space created by shielding an inside space of said developing apparatus, a developer supply unit, arranged in a lower position of said created space, to supply said developing agent onto said developing agent-bearing member;

first developer conveying member, arranged in said developer recovery unit;

second developer conveying member, arranged in said developer supply unit;

a shielding member, having first and second communication sections connecting said developer recovery unit and said developer supply unit, in accordance with both ends of said first and second developer conveying members in a longitudinal direction thereof respectively, wherein a guide section, provided in said shielding member, guides a developing agent which has left from said developing agent-bearing member to said first developer conveying member in said developer recovery unit, and a third communication section passes through said shielding member, said third communication section connecting and communicating said developer recovery unit and said developer supply unit, apart from said first and second communication sections.

2. The developing apparatus according to claim 1, wherein said third communication section is provided in between a longitudinal center of said first developer conveying member in said developer recovery unit and said second communication section on a downstream side in a flow direction of said developing agent.

3. The developing apparatus according to claim 1, wherein said third communication section is provided in a location position corresponding to a time position after a developing agent moving by said guide section of said shielding member begins to contact said first developer conveying member.

4. The developing apparatus according to claim 1, wherein an opening area of said third communication section is smaller than an opening area of said second communication section.

5. The developing apparatus according to claim 1, wherein an opening area of said third communication section is enough to move a volume of said developing agent which corresponds to a level of the developing agent unrecoverable at the position of said second communication section to said developer recovery unit.

6. The developing apparatus according to claim 1, wherein said guide section of said shielding member and said third communication section are provided starting from an edge section of said shielding member while facing said developing agent-bearing member and in a direction away from a surface of said developing agent-bearing member such that said guide section of said shielding member is closer to said developing agent-bearing member than said third communication section.

7. The developing apparatus according to claim 1, wherein an edge section of said shielding member, facing said developing agent bearing member, is arranged between two magnetic poles repelling each other of said magnetic poles built in said developing agent-bearing member.

8. The developing apparatus according to claim 1, wherein said first and second developer conveying members are screw members which rotate in the opposite direction to each other.

9. A developing apparatus for storing a developing agent which contains a toner and a carrier, and which develops a latent image on a latent image carrier with said toner, comprising:

a developing agent-bearing member, facing said latent image carrier, with magnetic poles formed around;

a developing agent control member, arranged under said developing agent-bearing member while facing this member, to control a volume of said developing agent on said developing agent-bearing member;

a developer recovery unit, arranged at an upper position of a space created by shielding an inside space of said developing apparatus, a developer supply unit, arranged in a lower position of said created space, to supply said developing agent onto said developing agent-bearing member;

first and second developer conveying members, using screw members arranged in said developer recovery unit and developer supply unit respectively;

a third communication section, being provided between bottoms of said developer recovery unit and said developer supply unit by communicating said bottoms, wherein said third communication section opens at a position facing screw wings of said first developer conveying member on a side of said developer recovery unit, and opens at a position facing an axis of between wings of said second developer conveying member on a side of said developer supply unit.

10. The developing apparatus according to claim 1, wherein a toner is used in said developing agent, having a shape factor SF-1 in a range of 100 to 180, and having a shape factor SF-2 in a range of 200 to 180.

11. The developing apparatus according to claim 9, wherein a toner is used in said developing agent, having a shape factor SF-1 in a range of 100 to 180, and having a shape factor SF-2 in a range of 200 to 180.

12. A process cartridge, comprising: a casing for housing said developing apparatus according to claim 1; a charging device for carrying out a charging step of charging said latent image carrier; and a cleaning device for removing residual toner from this latent image carrier.

13. A process cartridge, comprising: a casing for housing said developing apparatus according to claim 9; a charging device for carrying out a charging step of charging said latent image carrier; and a cleaning device for removing residual toner from this latent image carrier.

14. An image-forming apparatus, comprising a plurality of said process cartridges according to claim 12.

15. An image-forming apparatus, comprising a plurality of said process cartridges according to claim 13.

16. An image-forming apparatus, comprising said developing apparatus according to claim 1.

17. The developing apparatus according to claim 1, wherein the third communication section is provided in a position far from a surface of the developing agent-bearing member compared with that of a rotational axis of the first and second developer conveying members when the developing apparatus is viewed from a cross-sectional surface of the developing agent-bearing member in a rotational axis direction.

18. A developing device comprising:

a developer bearer to transport by rotation developer carried on a surface thereof to a development range to supply developer to a latent image bearer;

a development casing in which a developer conveyance channel is formed, the developer conveyance channel facing the developer bearer through a communicating area inside the development casing;

a developer supply member disposed in the developer conveyance channel to transport developer in an axial direction of the developer bearer and supply developer to the developer bearer;

a developer collecting member to transport axially developer received from the developer bearer at a position downstream from the development range in the direction of rotation of the developer bearer;

a developer regulator disposed facing a lower portion of the developer bearer to adjust an amount of developer carried on the developer bearer; and a partition to divide the developer conveyance channel into a supply channel in which the developer supply member is disposed and a collecting channel in which the developer collecting member is disposed, and the supply channel and collecting channel communicate at both end portions in the axial direction, wherein the communicating area includes a first communicating opening where the developer bearer faces the supply channel and a second communicating opening where the developer bearer faces the collecting channel, and a portion which passes through the partition disposed between the both end portions of the developer conveyance channel in the axial direction.

* * * * *